United States Patent [19]

Pearson

[11] 4,003,314

[45] Jan. 18, 1977

[54] SKI LIFT MONITORING

[76] Inventor: William F. Pearson, 5221 Duvall Drive, Washington, D.C. 20016

[22] Filed: Apr. 25, 1975

[21] Appl. No.: 571,851

[52] U.S. Cl. ..... 104/1 R; 104/173 ST; 104/178; 104/179

[51] Int. Cl.[2] ..... B61B 12/06

[58] Field of Search ..... 104/173, 178, 179, 117, 104/196, 1 R, 88, 89; 198/208, 233, 40, 37; 340/267 R; 317/43; 307/119; 235/92 R, 92 CA, 92 N

[56] References Cited

UNITED STATES PATENTS

| | | | |
|---|---|---|---|
| 3,023,353 | 2/1962 | Currey | 317/43 X |
| 3,054,100 | 9/1962 | Jones | 104/88 UX |
| 3,115,847 | 12/1963 | Turner et al. | 104/173 X |
| 3,132,243 | 5/1964 | Greissman | 235/92 R |
| 3,347,172 | 10/1967 | Sowder | 104/178 X |
| 3,756,370 | 9/1973 | Ingram | 198/37 |
| 3,809,832 | 5/1974 | Burger | 104/178 X |
| 3,844,223 | 10/1974 | Brian | 104/178 X |

*Primary Examiner*—Robert J. Spar
*Assistant Examiner*—Randolph A. Reese
*Attorney, Agent, or Firm*—Beall & Jeffery

[57] ABSTRACT

A plurality of ski lifts are individually monitored and the information displayed at a central location for each of the ski lifts, and further displayed at a common location for all of the ski lifts. Each of the ski lifts is shut down in response to various unsafe conditions automatically with simultaneous production of a corresponding safety signal introduced in the common ski lift power control circuit, each of which safety signal is assigned a frequency or current so that it may be separated at a central location from other signals carried in the circuit for processing display. The safety devices will open switches to reduce the current carrying capacity of the closed power circuit and thereby disconnect the power to the ski lift drive while maintaining a substantially lower current carrying capacity in the circuit for passing the safety signals along the circuit to the central location. Such safety signals relate to cable derailment, excess cable slack or cable breakage, safety manual stoppage, passenger unloading failure, low gear box oil pressure, overspeed, and bullwheel derail, for example. The number of passenger carrying units, the number of passengers, and the number of loaded passengers carrying units per unit time are compared to obtain various efficiencies. At the central and common locations, the information is visually displayed and selectively printed for a permanent record on demand, periodically and automatically.

17 Claims, 11 Drawing Figures

SKI LIFT MONITORING

BACKGROUND OF THE INVENTION

It is known to provide various safety switches for ski lift operation, such as a switch that will shut down the ski lift when it is sensed that a passenger has moved beyond the unloading position, when cable derailment occurs, and the like. However when cable derailment occurs, it may be very difficult to locate the exact location of cable derailment so that the problem may be corrected as quickly as possible. One method of determining such location is to provide a resistor, different for each such location, in shunt across the safety derailment switch so as to provide a different resistance of the total circuit for each such location for derailment location identity. However, such a system is difficult to use in that a momentary derailment switch operation may shut down the ski lift but not be a long enough duration to determine its location. Further if derailment occurs at more than one location, it may be very difficult to determine such locations. Further, the wide range of resistance values that would be necessary to determine the numerous possible locations in the circuit would require a substantially large corresponding range of current flow in the circuit upon shut down.

At the present time many ski areas, with multiple ski lifts are operated very inefficiently without the knowledge of management in that there may be long lines at one ski lift and no lines at another ski lift with no one being aware of the situation due to the substantial distances involved between the ski lifts. It is usual to provide manual ski lift stop switches at various locations along the ski lift, for example at an unloading area and a loading area. A ski lift may have one or more operators that are quite inefficient and repeatedly manually stop the ski lift, without management being aware of the situation in an efficient manner. Stoppage of a ski lift rated at 1200 skiers per hour for only 1 minute while handling a capacity crowd will increase the lift line by 20 skiers, and there is no way to recover from this added lift line length until some people stop skiing.

In general, there is no present efficient way of monitoring a ski lift or plurality of ski lifts so as to recognize chronic trouble areas, inefficiency, or to provide data for advanced planning, training and the like.

SUMMARY OF THE INVENTION

It is an object of the present invention to provide a method for monitoring ski lift performance in terms of uphill carrying capacity versus actual count of skiers carried, as well as detecting, counting and timing lift stoppages while determining the causes for the same. The method is to be employed for the supervision and planning related to ski lifts by reporting automatically and continually on the operating, loading and safety conditions of aerial tramways and ski lifts, both aerial and ground, including cable cars, gondolas, chair lifts, J-bars, T-bars and seat or platter lifts. The monitoring is preferably conducted at central locations visually on cathode ray tubes and selected data is automatically or on demand printed for permanent records.

An assortment of safety, capacity, and the like sensors are mounted on or about various mechanical and electrical components of the ski lift so as to report on various ski lift operating conditions. These sensors produce tuned frequency signals, with a predetermined fixed electrical characteristic assigned to each such sensor, in a common ski lift power control circuit; the signals are separated according to characteristic at a central location, and after separation are processed and displayed visually. Sensed conditions include lift speed, gear box oil pressure, cable jamming, passenger unload failure, cable slack excess and breakage, manual safety switches, cable derailment at support towers and bullwheels, load units per time, passenger carrying units per time, passengers carried per unit of time, and the like. The visually displayed and recorded information relates to: identification, stop time and start time for the safety stoppage; accumulated stoppage time, accumulated running time, lift speed, number of passengers on the lift, various efficiencies such as loads as a percentage of load units and passengers as a percentage of load units or loads; elapsed time, number of starts, number of stops, number of loads on the lift, and the like.

Selected data are automatically printed at fixed time intervals, printed on demand, and printed upon change; selected data are visually displayed.

With this information, management could control skier density on capacity days by being informed as to which lifts were not crowded so that skiers may be moved to uncrowded lifts, and on less than capacity days which lifts should be closed, if any. Such information being instantaneously provided at a central location would greatly facilitate supervision. In the long range, uphill counts of skiers provides reliable planning information regarding new lift construction land use, environmental considerations, etc.

Lift stoppage data directly indicates the lifts operating condition, the adequacy of the loading and unloading ramps and the proficiency of the lift operators. By knowing the frequency, duration, and sources of lift stoppages, management can take informed, concentrated action to reduce or eliminate the causes for stopping. This would increase the effective uphill lift capacity thereby shortening lift lines and improving customer satisfaction.

Written records of lift operating conditions and safety factors would greatly improve the reliability of information relating to accidents and particularly the determination of liability with respect to accidents.

This information would also provide advanced warnings of conditions that could lead to lift-involved accidents to skiers.

When closing down a lift at the end of a day or when closing it down due to low capacity operation, it is necessary to know if any skiers are stranded on the lift. Heretofore patrols have been required to use a considerable amount of time skiing down the mountain to visually observe the lift throughout its length, but even this system is not reliable due to weather conditions, mountain conditions providing access to the lift area, and human error so that many times skiers are stranded for hours in mid air. The present method automatically determines the presence of passengers remaining on the ski lift.

Records can be kept with the present method as to the stoppage sources and frequency, so that areas requiring major maintenance or redesign can be accurately determined. Further, various major breakdowns may be anticipated due to the monitoring so that conditions may be corrected before the major breakdowns occur.

With use of a single closed power control circuit for carrying the signal data and signal source information, the expense of a monitoring system may be minimized in that no additional wiring along the length of the lift is required, which is a considerable saving considering that a ski lift may span a distance of up to 9000 feet.

BRIEF DESCRIPTION OF THE DRAWING

Further objects, features and advantages of the present invention will become more clear from the following detailed description of the drawings, wherein.

DETAILED DESCRIPTION OF A PREFERRED EMBODIMENT

Figures 1A, 1B:
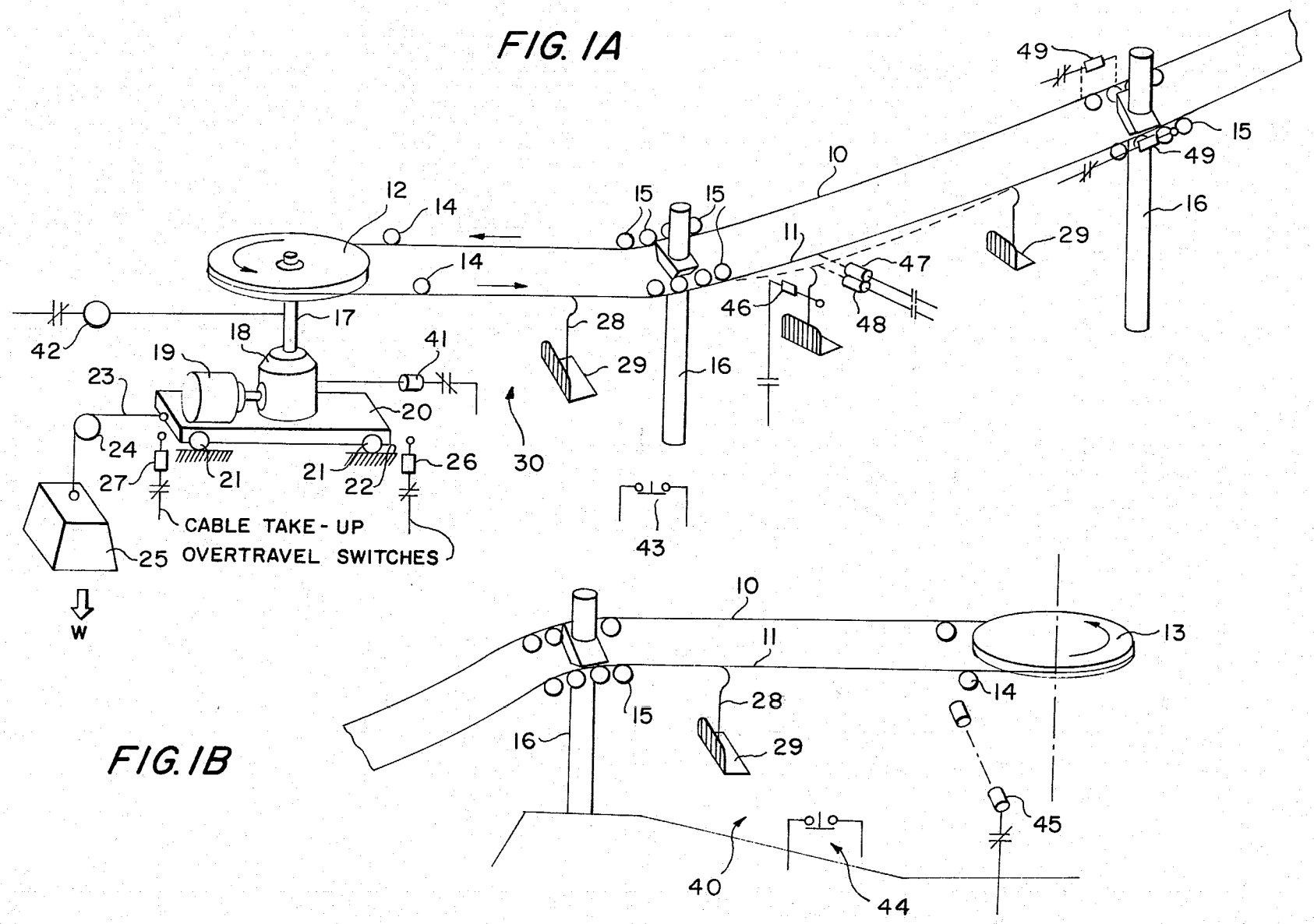
FIG. 1A and 1B are a schematic representation of a ski lift showing the location of the various automatic safety switches, manual safety switches, and condition sensing switches.

While the present invention may be used with any type of mechanism generically known as a ski lift for transporting skiers up a mountain, for purposes of illustration, it is shown with one specific type of ski lift.

In the type of ski lift illustrated, a cable is moved in an endless path having a downhill run 10, an uphill run 11, a downhill direction reversing and driving bullwheel 12, and a uphill direction reversing idling bullwheel 13. The cable is guided into and away from the bullwheels by means of guide pulleys 14. Immediately adjacent the bullwheel 12, the cable is guided in a generally horizontal direction for picking up passengers and then engages a plurality of rotatable cable guide wheels 15, the first set of which moving uphill holds down the cable and the remaining sets support the cable from beneath. The rotatable wheels 15 have annular grooves, like the bullwheels, and are supported on towers 16. Since the total length of the conveyor may be, for example, 9,000 feet, a large number of such towers 16 and support wheels 15 are needed throughout the extent.

For driving the ski lift, the bullwheel 12 is drivingly secured to shaft 17 extending from a gear box housing 18, which is in turn driven by a motor 19. The motor 19, gear box 18, shaft 17 and bullwheel 12 are all mounted on a carriage 20 supported by wheels 21 on a flat stationary support surface 12 for reciprocating movement toward and away from the immediately adjacent tower 16. Since the cable is quite heavy and to this inherent weight must be added the passenger supporting mechanisms and the weight of the passengers, a cable 23 is connected at one end to the carriage 20, guided around pulley 24 and connected at its opposite end to a counterweight 25, to maintain tension on the cable despite variations in load, weather conditions, and stretching of the cable, for example. Under normal conditions, the carriage will reciprocate back and forth as conditions vary, but if the carriage moves too far forward indicating an abnormal condition, a forward normally closed limit switch 26 will be opened to indicate such overtravel; if the carriage moves too far to the rear as a result of abnormal conditions, such as cable overstretching, cable partial breakage, or the like, a rear normally closed limit switch 27 will be actuated and opened to indicate excess cable take up.

For actually transporting the passengers, a plurality of suspension hooks 28 are secured at generally even spacing along the length of the cable and support at their lower end a chair 29, capable of supporting two people. Between the driving bullwheel 12 and the first tower 16, the chair 29 will be moving in a generally horizontal direction closely adjacent the ground in a loading zone 30 where passengers will be loaded onto the chairs for travel uphill to another generally horizontal run of the cable between the last tower 16 and the idling bullwheel 13, where the passengers will leave the chair 29 at the unloading zone 40 where the ground surface is slopped slightly away from the last tower 16 in the conveying direction so that the skiers may ski away from the chair 29. Thereafter, the chairs 29 will move downwardly along the cable run 10; for simplicity, chairs have not been shown along the cable run 10 or around the bullwheels although they are at these positions, and further the midportion of the conveyor has been shown because of its extreme length The oil pressure or oil level, in the gear box 18, is measured by normally closed sensing switch 41, which will open to indicate that the gear box is low on oil and needs more oil. The speed of the drive mechanism is monitored at a suitable location, for example at shaft 17, by some type of known tachometer 42 with a normally closed switch, to open the switch upon overspeed.

In normal ski lift operation, at least one attendant is positioned in the loading zone 30 to assist passengers onto the chair 29 and perform other such services. If an attendant desires to stop the conveyor, usually because of some unsafe conditions observed, the attendant will open normally closed manual switch 43. Similarly, one or more attendants are positioned at the unloading zone 40 to assist passengers in disembarking from the conveyor, and if for any reason an attendant at the unloading zone 40 desires to stop the conveyor, the attendant will open the normally closed manual switch 44. Further, various manual switches are preferably located at intermediate points along the conveyor run where attendants may be stationed, so that they too may manually stop the conveyor whenever desired, although such intermediate switches are not shown.

If a passenger fails to leave the chair 29 at the unloading zone 40 and the attendant does not observe this condition and stop the conveyor with switch 44, an automatic sensor 45 will determine the presence of a passenger beyond the unloading zone 40 and open its normally closed switch to stop the conveyor. This sensing switch may be a photoelectric sensor as shown, any type of proximity sensor, a wand switch or a foot engaging cable switch, for example.

Immediately uphill from the loading zone 30, a wand switch 46 will operate every time that a chair moves past its location, which indication together with a clock mechanism will provide information as to the effective speed of the conveyor in chairs per minute, for example. This switch may be located wherever desired, because the information should be the same throughout the entire length of the cable since the chairs are generally uniformily spaced throughout the length of the cable. Two or more proximity switch sensors 47, 48 are preferably placed adjacent the cable run 11, in vertically stacked relationship, between the loading zone and unloading zone to determine the number of loaded chairs. Between the towers 16, on opposite sides of the switches 47, 48, the cable will move downwardly in stepwise increments for each step increase in load, in general. Thus, the plurality of switches 47, 48 will indicate step increases in load, which may give an approximation of the number of passengers being transported by the conveyor, and at least the number of loaded chairs of the conveyor.

Due to various causes, the cable may become derailed from its respective support wheels 15, guide pulleys 14, or bullwheels 12, 13. There are many known types of switches to sense such derailment at all of these locations, and for purposes of illustration, such cable derailing switches 49 have been shown at only one of the towers 16, although it is understood that they will be present throughout the system wherever the cable may become derailed. These normally closed switches will open upon sensing derailment.

Figure 3:
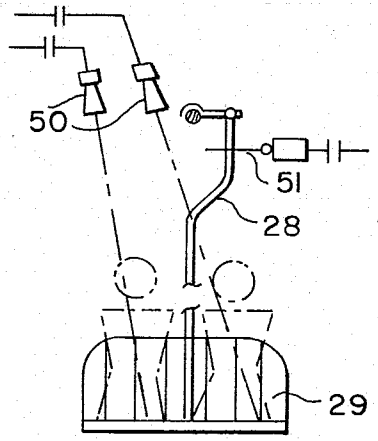
FIG. 3 is another view of the counting mechanism of FIG. 2.
Figure 2:
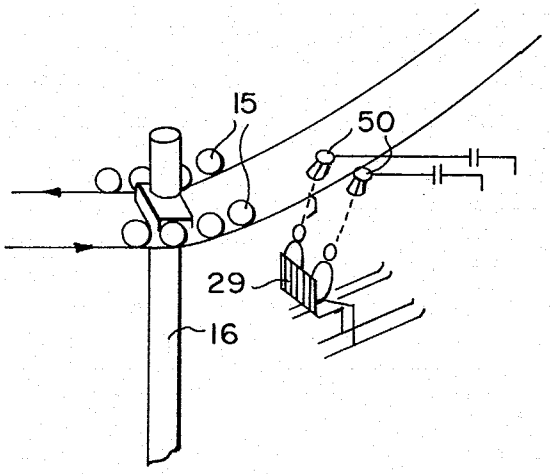
FIG. 2 shows a portion of FIG. 1, but with different means for counting the passengers.

Instead of, or in addition to the sensing switches 47, 48 proximity sensors 50 may be used as shown in FIG. 2, which proximity sensors are directional so as to be actuated only by a passenger on the chair in a particular location. The chair 29 may be stabilized at such location to enhance the accuracy. The sensors 50 may be infra-red sensors, ultrasonic sensors, capacitive sensors, or the like and equal in number and corresponding in position to the number of passengers that would be carried by the chair 29. That is, there would be two sationary sensors 50 for a two passenger seat as shown, three sensors for a three passenger seat, etc. Another view of these proximity sensors 50 is shown in FIG. 3, together with a wand switch 51 for counting the number of chairs passing the sensors 50. If the passenger counting sensors 50 were provided in addition to the load counting sensors 47, 48, then the switch 51 would in fact be the switch 46, since wand 51 and 46 perform the same function. Also, sensors 50 would indicate a loaded chair.

Figure 4:
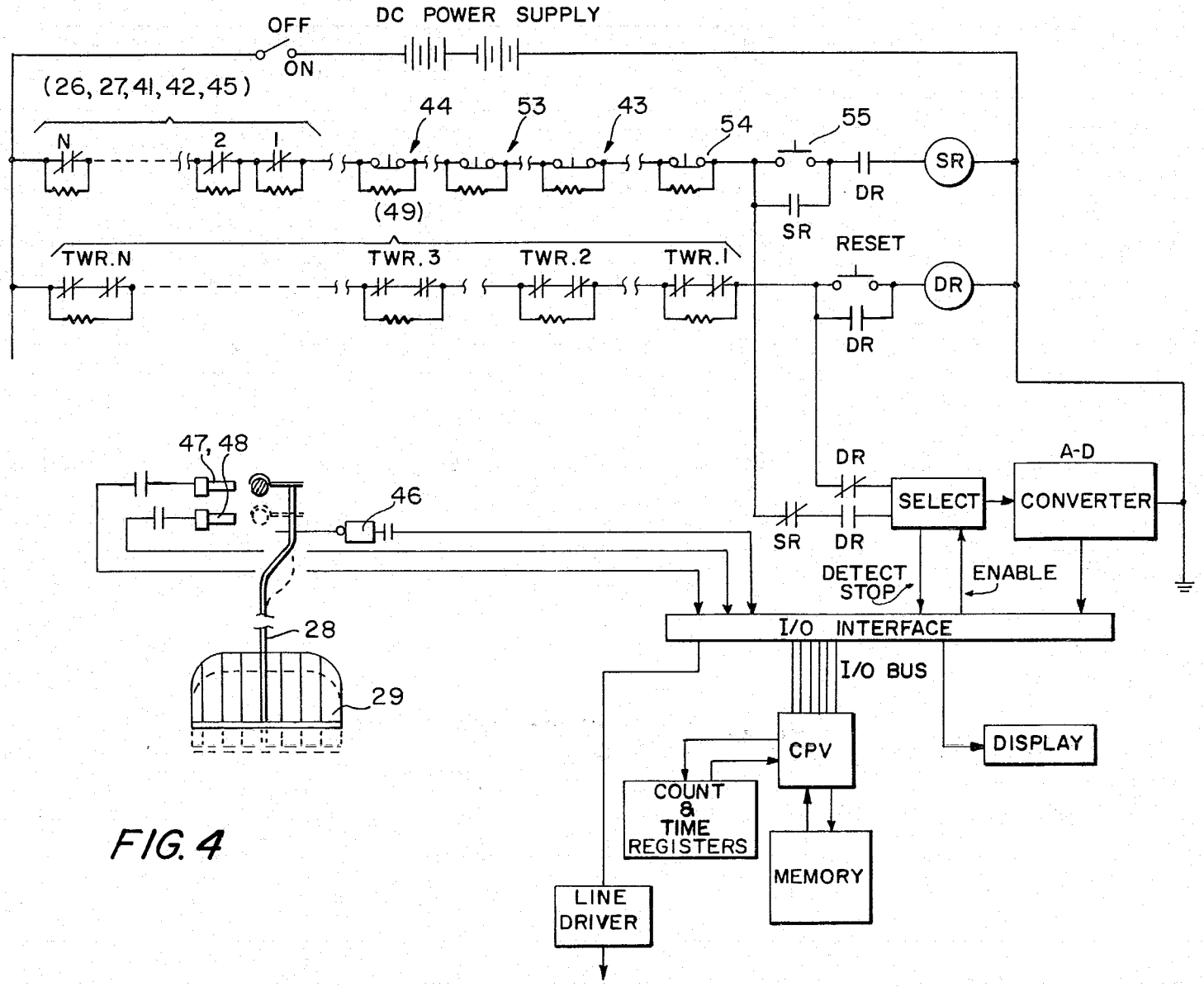
FIG. 4. is an electrical schematic of the manner in which the various switches are arranged in circuit and connected to the process and display apparatus.

The various automatic safety, manual and condition sensing switches described with respect to FIGS. 1 through 3 are generally shown in circuit in FIG. 4.

For normal operation of the conveyor, the DC power supply switches is turned from its off position to its on position to energize the system. Thereafter, the opertor in a control shack will press the reset switch and then the start switch 55 to temporarily close them; closure of the reset switch will provide a closed circuit through the power supply, the various cable derailing switches 49 that are indicated as TWR 1 through TWRN because a large number of such switches are normally provided, and the derail relay coil DR. Energization of the coil DR will close normally open switch DR to bypass the reset button, so that the reset button may then be released without deenergizing the circuit through the tower cable derailing switches 49. With closure of switch DR and start switch 55, the starting relay coil SR will be energized through the normally closed switches in circuit within it and the DC power supply; energization of starting relay coil SR will close normally opened switch SR to bypass start switch 55, so that start switch 55 may thereafter be released. The drive motor 19 for the driving bullwheel 12 will be energized and driven in a separate power circuit with closure of a switch (not shown) actuated by the starting relay coil SR.

In the control circuit shown in FIG. 4, there are two basic closed loops with the DC power supply, one being the circuit having in series the various cable derail switches 49 and coil DR; the other circuit having in series the various automatic safety switches, for example 26, 27, 41, 42, 45, the manual loading, unloading, and intermediate switches 43, 44, 53, and the stop switch 54 within the control shack, and the starting relay coil SR. It is thus seen that if any of the automatic safety switches 26, 27, 41, 42, 45, manual switches 43, 44, 53, stop switch 54 were opened, the starting relay coil SR would be deenergized to automatically open the motor power circuit switch (not shown) to stop the drive motor 19; further, deenergization of the starting relay coil SR would open switch SR to require that the start switch 55 be reactuated once the problem has been removed, that is, the conveyor would not automatically start even upon closure of the switch that orginally broke the circuit containing the coil SR. If any one of the cable derail switches 49, which would include the bullwheel derailing switches and the like, were opened, they would deenergize the relay coil DR; this would open the switch DR in series with the starting relay coil SR, to deenergize the coil SR with the results mentioned above with respect to deenergizing this coil; further, deenergization of relay coil DR would open the switch DR in shunt with the reset button, requiring operation of the reset button in addition to the start button before the conveyor may be restarted.

The cable derail switches 49 are shown in pairs for each of the towers, because at least one switch would be provided for each side of the tower correponding to the uphill run 11 of the cable and downhill run 10 of the cable, although it is understood that even more switches may be provided for each of the towers.

When the ski lift stops, it is desirable to know the reason for the stoppage at a central location. If one of the cable derailing indicating switches causes stoppage of the conveyor, it would be extremely difficult to locate the problem considering the great length of the conveyor, the considerable height of the towers, weather conditions, and the like and further many times such a cable derailing switch will stop the conveyor although it is opened only briefly and there is no way of visually determining what switch caused stoppage of the conveyor if it were to quickly close again according to known systems. It is further even desirable to know when the manual switches have been operated, because the frequency of operation of one switch may indicate the need of more training for the attendant associated with the switch, or the correcting of other conditions at such location. Such reasons for knowing the location of the switch causing stoppage of the conveyor and the length of time that the switch is opened, are merely set forth by way of example, and in general conveyor efficiency can be improved greatly if management is provided with such information.

Each of the above mentioned automatic or manual normally closed switches that when opened will stop the conveyor is provided with a resistor in shunt with its contacts, as shown in the drawing (all of the switches associated with one tower may be parallel with a single such resistance if desired, as shown). At least for each of the two circuits in parallel with the DC power supply, the shunt resistors will be of fixed predetermined value substantially different from each other for purposes of identification. For example, if switch 44 were opened, the resistor associated with switch 44 would effectively be placed in circuit with the starting relay coil SR; all of the shunt resistors are of very large resistance so that whenever one of the shunt resistors is effectively placed in circuit by opening its associated switch, the current flowing in the line in series with such switch resistor will drop drastically in value and be insufficient to energize either the relay SR or the relay DR. Thus, with opening of switch 44, the resistance of the circuit including the starting relay coil SR will greatly increase and correspondingly reduce the current within such circuit so as to deenergize the starting relay coil SR and open the switch SR, so that no current will then flow through the coil SR. However, current will flow through the resistor associated with switch 44, all of the normally closed switches in series with switch 44, DC power supply, the SELECT circuit, and the A-D converter.

To determine which switch opened, the computer CPU successively sends enabling signals to the select circuit to sample either the circuit containing the switch 44 or the circuit containing switches 49. When the circuit containing switch 44 is sampled, the value of the current passing through the resistor associated with now open switch 44 will be converted from its analog form to a digital form by the A-D converter and passed as a digital current value to the computer CPU. The computer has associated with it a MEMORY which in effect is a table of correspondence between current value and switch identity, that is, there will be a value of current characteristic of whatever one of the resistances is placed into effective circuit by opening of its corresponding switch. The computor will match the digital current value from the A-D converter with the closest value supplied by the memory and thus identify which of the switches, in this case switch 44, has been opened. This identification of switch 44 will then be suitably visually displayed on the "Display." Further, the "count and time registers" are such that a separate count register is provided for each of the above-mentioned safety switches, whether automatic or manual, and a separate time register is provided for each such safety switch (alternatively, some switches may be grouped with respect to a single register, for example, all of the cable derailing switches may be grouped on a single time register). Thus, with opening of switch 44 and its identification, a count of one will be added to the count register for switch 44 and the time that switch 44 remains open will be added to the time register for switch 44. This information will be stored on the register, so that upon demand the computer may print out or otherwise supply information as to the number of times that switch 44 has opened and the total elapsed time that the lift has been stopped because switch 44 had been opened. Of course, the same information would be provided for each of the safety switches (or any grouping of safety switches).

Since the computer separately samples the circuit containing the cable derail switches 49 at a time other than its sampling of the circuit containing the other automatic switches, resistance values of one circuit may be independent of those of another circuit, for example, the cable derailing switch associated with tower 2 may have a shunt resistor identical with the manual safety switch 43, and the computer will be able to distinguish between these two switches according to which circuit is being sampled. It is contemplated that further parallel circuits may be set up to correspondingly increase the number of circuits to be sampled and reduce the number of separate value resistors to be provided and whose values are stored in the memory.

The computer may sample the circuit containing open switch 44 and match the value of its shunt resistor effectively placed into circuit by opening of the switch 44 with corresponding value from the memory and identify the switch 44 for displaying of the information all within 5 to 10/1000 of a second. Thus, the switch 44 even though opened momentarily will be identified by the computer.

It has been known to provide shunt resistors or different value for cable derailing switches, so that when one of the cable derailing switches was opened, the shunt resistor associated with it would be placed effectively in circuit to reduce the current flow. Upon observing that the conveyor was stopped, an attendant would then use an ammeter or a current balancing device like a wheatstone bridge to measure the current flow so that such current flow could be compared with a printed table of correspondence between current flow and resistor identity and thus switch identity. However, such a manual process would take a considerable length of time and be useless with respect to a switch that would open only momentarily and thereafter shut, even though it would stop the conveyor. Further, there would be no stored or displayed identity of the open switch unless the attendant wrote down such information correctly. In contrast, the present system will immediately identify the switch, display such identity, and store information relating to the stoppage. Further, various compensation factors may be built into the computer program to take into account such factors as temperature variations upon the current flow values.

All of the above-mentioned equipment will be provided for each ski lift, but many installations involve a plurality of ski lifts. For ski lifts, FIG. 4 shows a "line driver" that will send all of the information from the computer CPU to a central processor which receives similar information from other ski lift areas, which central processor may display, record and the like such information.

Figure 5:
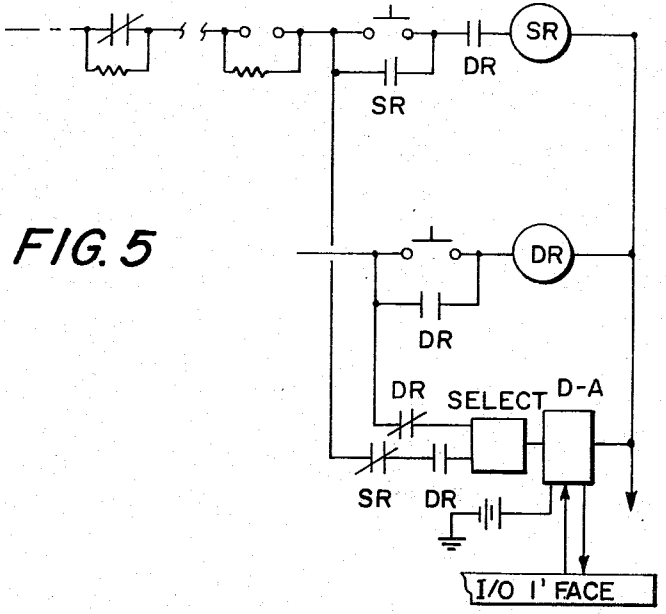
FIG. 5 shows a portion of FIG. 4 with a variation in the method of detecting the open switch.

According to FIG. 5, a means for identifying the open switch may be different from that described with respect to FIG. 4. In FIG. 4, a digital value of the current in the selected parallel switch circuit was sent to the computer to be compared with stored information or identity; in FIG. 5, stored digital values for current are successively sent by the computer to the D-A converter to be changed to analog form for bucking the current of the selected parallel switch circuit, so that when the counter current produced by the D-A converter substantially equalled the current within the chosen switch parallel circuit, a null indicator informs the computer that the just supplied value of current from its memory corresponded to the open switch, for identification purposes.

Figure 6:
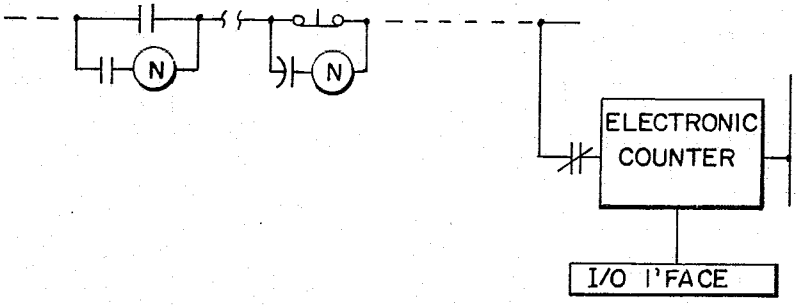
FIG. 6 shows a further variation in the method of detecting the open switch.

FIG. 6 shows still another means for identifying the open switch. Instead of having a resistor in shunt with each normally closed switch, FIG. 6 employs a system wherein a frequency generator, for example a tuned resonant circuit, is placed in shunt with each of the switches and each such frequency generator will have a fixed predetermined frequency characteristic of its switch in the manner previously explained with respect to each resistor having a value characteristic of its switch with respect to FIG. 4. Thus, when one of the switches of FIG. 6 is opened, its associated frequency generator shunt circuit will produce a signal of a fixed predetermined frequency which will be fed to the "electronic counter" where the number of pulses for a predetermined period of time (the frequency) will be determined and compared with the memory of the computer for identification of its switch.

In FIGS. 5 and 6, only a portion of the circuit shown in FIG. 4 has been shown and only the differences have been described, and it is understood that the remaining portions of the circuit and function will be identical with FIG. 4.

Figure 7A:
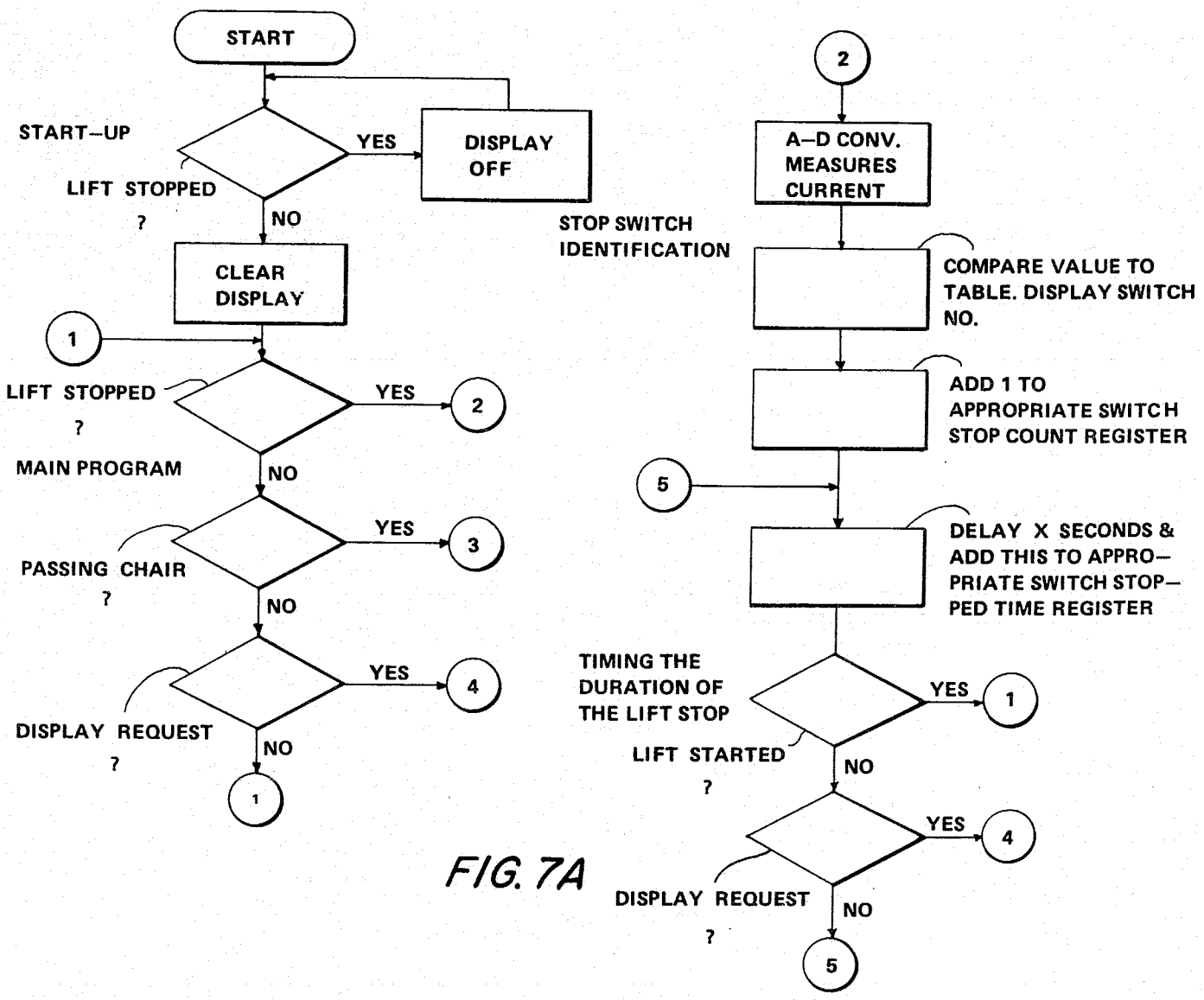
FIGS. 7A and 7B show a simplified computer program for processing the monitor information.
Figure 7B:
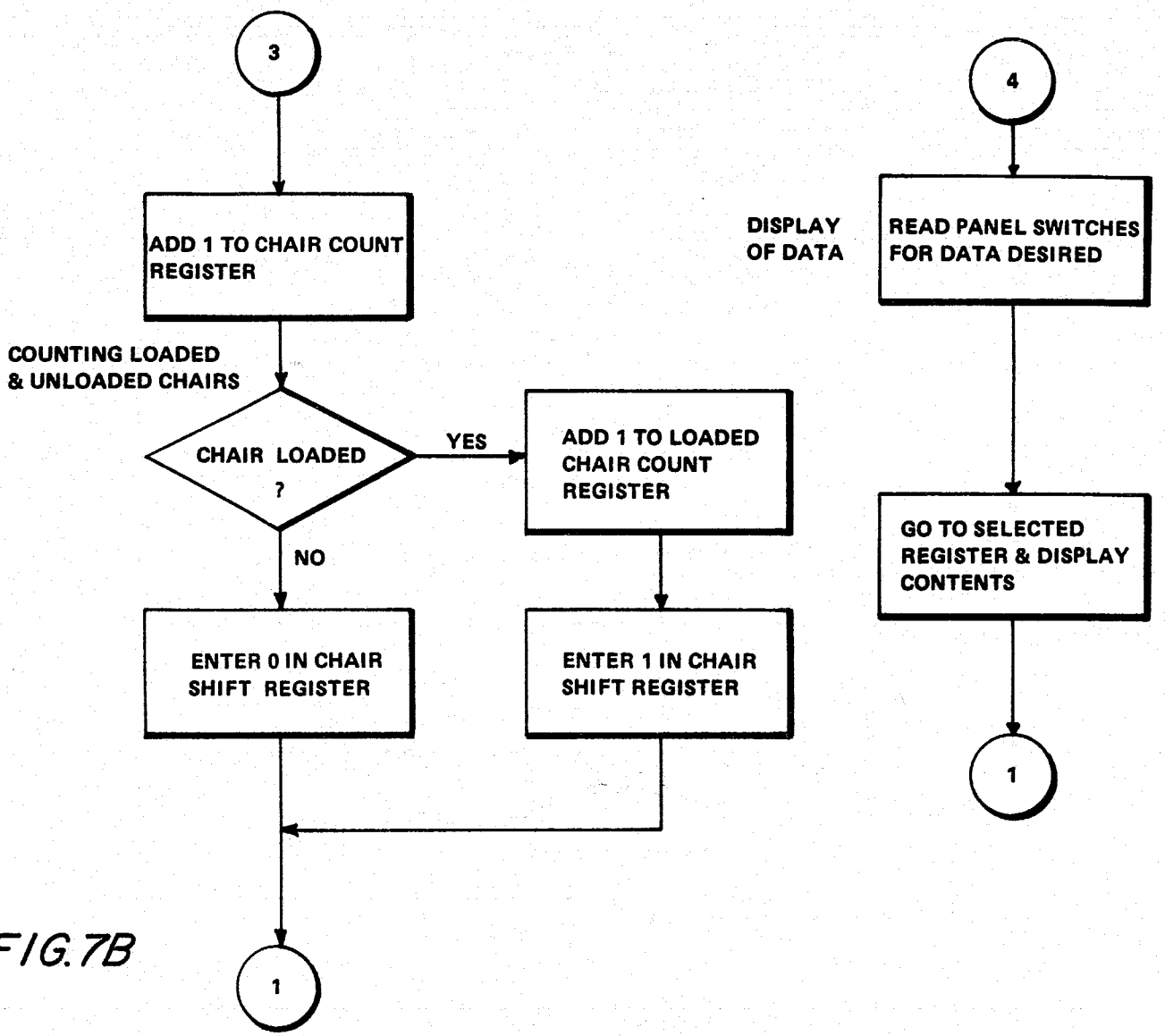

A computer program flow diagram is shown in FIG. 7 for the circuit of FIG. 4, and it would be similar for the modifications according to FIGS. 5 and 6. This flow diagram is simplified for purposes of illustration and one having ordinary skill in the art of computer programming would realize the details of an actual necessary program that would be required for the operations to be briefly described.

In the left hand portion of FIG. 7, with starting of the computer, the computer would perform a test function "lift stopped?" and if the answer to this is yes, the word "off" or a similar visual indication would be displayed and the computer function would again be returned to the start position as indicated by the return arrow so that it would again ask the question "lift stopped?". As soon as the answer to this question is no, the computer would then proceed the operation "clear display" where it would clear any information displayed; it is contemplated that even though the signal for clear may be sent out by the computer, there may be a predetermined delay built into the circuit so that the display will remain for a predetermined period of time, if desired. After the signal for clearing the display is sent out by the computer, the computer will perform the test of effectively asking the question "lift stopped?" (the function beneath the "clear display"), and if the answer to this question is yes, the computer program will proceed to the top of program "2", which is the program second from the left in FIG. 7. If the answer to this immediately preceeding question is no, the computer will proceed to the function "passing chair?"; if the effective answer to this question is yes that a chair is passing, then the computer will proceed to computer function "3", which is the third computer function from the left shown in FIG. 7. If the answer to the test question "passing chair?" is no, the computer will proceed to the test question "display request?". If a display has been requested, the computer will proceed to program "4", which is the program that is fourth from the left in FIG. 7. If the answer to the question "display request?" is no, the computer will then proceed to function "1", which in the program to the left of FIG. 7 would be at a point between the "clear display" operation and the "lift stopped?" function immediately below the "clear display" operation as shown by the input arrow "1". Thus, so long as the answers to the three questions now in function "1" remain no, the computer will in succession keep asking such questions according to the main program, and as soon as the answer to any one of the three questions in the main program is yes, the computer will automatically shift the corresponding program "2", "3", or "4", accordingly.

When in the main program, the computer determines that the lift has stopped and shifts to program "2", the current flowing in the selected parallel switch circuit of FIG. 4 will be converted from its analog form to a digital form by the A-D converter of FIG. 4 as previously explained according to the control program of the computer for stop switch identification. This digital current value will be compared to a plurality of values corresponding to switch identification from the computer memory to obtain the identity of the switch that has opened. When the identity of the opened switch has been determined, one count will be added to the corresponding switch stop count register. Thereafter, the computer will have a programed predetermined delay, which still may be a fraction of a second before proceeding along the flow diagram, and this delay is automatically added to the stopped time register associated with the identified opened switch. After this delay, the computer will perform the test of asking the question "lift started?", and if the answer to this is yes, the computer will proceed to the point "1"in the main program. If the answer to this question is no, the computer will then ask the question "display request?"; if the answer is yes, the computer will will proceed to program "4" shown in FIG. 7; although program "4" will be described later, when the computer goes to program "4" from program "2", it will be returned back to program "2" at point "5" instead of "1" that has a actually been indicated with respect to program "4". If the answer to the question "display request?" is no or upon the completion of program "4", the computer will be returned to point "5" in program "2" for a further delay that will be added to the appropriate switch stopped time register. In this manner, the timing of the duration of the lift stop will continue until the answer to the question "lift started?" is yes, at which time the computer will be returned to the main program.

If when the computer is in the main program, the answer to the test function question "passing chair?" is yes, the computer will be transferred to function "3". In function "3", one count will be added to the chair count register, then the computer will effectively ask the question "is the chair loaded?", which question would be determined by, for example, the switches 47, 48, 50. If the answer to this question is yes, one count would be added to the loaded chair count register, which would record the total number of chairs loaded, for example for that particular day. Further, one count would be added to the chair shift register. If the answer to the question "chair loaded?" in function "3" is no, an effective 0 will be provided the chair shift register. The chair shift register is such that it will only store information for the actual chairs between the loading zone 30 and the unloading zone 40 for the uphill run 11 of the cable so that when one chair leaves the loading zone, the shift register will indicate whether or not it is loaded and this information will be maintained in the shift register and continually shifted until such time as the chair leaves the unloading zone. Thus, the chair shift register will store information as to the exact number of loaded chairs in the conveyor system at any instant. After leaving either operation of the computer relating to adding a 0 or 1 to the shift register, the computer will return to the main program "1". Here it must be remembered that the speed of the compactor is extremely fast so that all the functions and operations in program "3" could be performed while either the switch 46 or 51 still indicates the presence of a single chair, so that a built in delay would be provided in the program sufficient to allow passage of that single chair that has already been counted before the computer is again capable of entering program "3" so that the same chair will not be counted several times.

When the computer is in the main program and the answer to the test function "display request?" is yes, the computer will be shifted to the program "4", which will be a display of data. The computer then will read the panel switches for the desired data. At the data display location, which may be the control shack, a central office, or the like, there will preferably be provided one or more selector switches that may be set to indicate a desired piece of information from the computer (for example, the selector switches may be desired to indicate the number of chairs per minute for the conveyor speed or the total amount of time that all of the cable derailing switches have been opened for the day). After such selection, a normally neutral position switch, that is biased into a neutral position, may be operated manually to inform the computer that the selected data is to be displayed, and the computer will then go to the appropriate register and display the contents of that register. As soon as the display demand switch is released, its bias will return it to its neutral position and the computer will continue with its main program while the selector switches are operated to provide an identity for the next piece of information desired, after which, the display demand switch may be actuated again so that the computer will go to the selected register and display its contents. A latch for the display is provided so that once the information is displayed, it will remain displayed for a predetermined period of time, or until the selector switch is moved at which time the display will be cancelled, or when the demand switch is released, whichever is desired. It is contemplated that a simple display unit may be provided in the control shack and consist of one or more of the selector switches that may be turned to various values which according to a chart will select a piece of information to be displayed; the display demand switch that may have one position to display a value such as chairs per minute or the total number of stops for a switch, a second position for displaying accumulated time, and its third neutral normal position; and a display window having, for example, a three digit LED display. Further, whenever the lift would be stopped, a separate warning light indicating stoppage of the conveyor would be actuated in the control shack and the LED display would indicate the identity of the safety switch that opened, which identity would be latched for a desired time.

TABLE I

| Source Identity | Time Print | Value | Signal Light | Σ Number | Σ Off time |
|---|---|---|---|---|---|
| A overspeed | X | X | X | X | X |
| B oil pressure | X | X | X | X | X |
| C safety gate | X | X | X | X | X |
| D unloading manual stop | X | X | X | X | X |
| E bullwheel derail | X | X | X | X | X |
| F misc. automatic (specify) | X | X | X | X | X |
| G broken or stretched cable | X | X | X | X | X |
| H mid-station manual stop | X | X | X | X | X |
| I cable derail | X | X | X | X | X |
| J cable derail | X | X | X | X | X |
| L passenger count | | X | | X | |
| M loaded chair count | | X | | X | |
| N loading manual stop | X | X | X | X | X |
| O chair count | | X | | X | |
| P passengers | | X | | X | |
| Q efficiency $\left[\frac{\text{passengers}}{\text{chairs}}\right]$ | X | X | | | |
| R efficiency $\left[\frac{\text{loaded chairs}}{\text{chairs}}\right]$ | X | X | | | |
| S elapsed time | X | X | | | X |
| T running time | X | X | | | X |
| U stopped time and number total | X | X | | X | X |
| V number of loads on lift | | X | | | |
| W $\left[\frac{\text{chairs}}{\text{min.}}\right]$ | X | X | | | |
| X $\left[\frac{\text{loads}}{\text{min.}}\right]$ | X | X | | | |
| Y $\left[\frac{\text{passengers}}{\text{min.}}\right]$ | X | X | | | |
| Z speed efficiency W/K | X | X | | | |

After displaying according to program "4", the program indicates that the computer returns to program "1", that is the main program, but as previously mentioned if the display request was obtain while the computer was in a repeat program other than the main program "1", for example if the computer was in repeat program "5" for timing the duration of the lift stop, the computer would then be returned from the display of data program "4" to the repeat program from which it was taken, which in this example would be program "5" for timing the duration of the lift stop. This could be performed by a flag in the computer program.

Many other desired programs may be built into the computer for providing any information desired that can be obtain from the sensors located along the ski lift. Since the computer has a built in clock effect, the chair sensing information may be differentiated to produce a conveyor speed in terms of chairs per minute, for example. Further, various ratios between data may be determined by the computer, to obtain different efficiencies that in turn may be displayed upon demand. As an example of such data that may be computed and displayed by the computer from the sensors described with respect to FIG. 1, reference is made to Table I.

In Table I, various information A through Z may be displayed upon demand as mentioned above or printed out, as will be mentioned below. Safety switches 42, 41, 45, 44, a switch like 49 associated with either bullwheel 13 or a bullwheel 12, anyother type of automatic safety switch (for example a derailment switch associated with a guide pulley 14 or the overtravel switch 26, or any number), cable take up switch 27, and attendant manual switch located between the loading zone 30 and the unloading zone 40 (not shown), cable derailment switches 49 at the first tower 16, cable derailment switches 49 located at the second tower 16, etc., and the loading manual stop switch 43 — correspond respectively to the source identity of Table I -A, B, C, D, D, F (of any number ), G, H, I, J, etc., and N. Anytime any of the automatic safety switches is opened, as shown by Table I, the computer will record by printing by a suitable printer the real time (for example, 9:33 p.m.), will print permanently and display temporarily the identity of the open switch (value in the Table), light a warning signal light common to all of the safety switches that would indicate conveyor stoppage, record in the register associated with the open switch the fact that the switch stopped and if desired periodically or on demand print or display the total number of stops for that particular switch or for a particular grouping of switches (Σ number in Table I), record in the register associated with the open switch the total time that such switch is in its off position and permanently record or temporarily display periodically or on demand the total off time for that particular switch or a particular grouping of switches (Σ off time in Table I). As shown by Table I, the following information would be obtained by the computer: L, M, O, and P from information produced by sensors 47, 48 that would provide a rough passenger count according to incremental load changes, 47 and 48 according to the presence or absence of any load, 46, and 51, and 50. According to the Table, this information would be recorded on registers to keep track of the total number of such counts for a fixed period, for example an entire day or an entire week of operating the conveyor. Also, the value of this information could be selectively on demand or periodically temporarily displayed or permanently printed.

Efficiency Q is obtained by the computer from driving P or L by O; efficiency R is obtained by the computer in dividing M by O. These efficiencies may be temporarily displayed on demand as a value or permanently printed on demand or periodically along with a real time indication.

Further, the computer will keep track of elapsed time, that is the time in any one given day from the starting of the conveyor at the beginning of the day up to the present S; also, the computer will keep track of running time T, which will be the total amount of time during the day that the conveyor is actually running. The stopped time U would be obtained by subtracting T from S. These times are maintained in the computer and may be temporarily displayed on demand or permanently printed along with the real time of their printing on demand or periodically. Further with respect stopping, the computer will keep track of the total numbers of stops from all sources on a register, or the total number of stops for a grouping of sources for one or more separate registers corresponding to the types of groupings desired, which information may be temporarily displayed on demand or permanently printed with a real time indication on demand or periodically.

The number of loads on the lift at any instant, V, is obtained from signal producers 47, 48, 46, 51 as processed according to computer program "3" of FIG. 7 and stored on the shift register. This information may be temporarily displayed on demand and is particularly useful in emergencies or upon shutting down or a ski lift when the operator believes that no one is on the ski lift; if the computer actually indicates that a load is on the ski lift, then the conveyor would be started again until the load were removed, with it being understood that the attendant at the loading area would prevent further loading since it would be desired to shut down the conveyor either at the end of the skiing day or when the usage of the conveyor does not justify its continued operation when other conveyors are available.

The effective speed or capacity of the conveyor as measured in chairs per minute W is obtained by the computer differentiating the information gained from switches 46, 51, and this information may be temporarily displayed on demand or printed with a real time indication on demand or periodically. Similarly, the loads per minute X and the passengers per minute Y are obtained by differentiating the signals from switches 47, 48 and 50, respectively, or 47, 48 and 47 and 48 respectively for display in printing similar to the information W.

The speed efficiency Z is obtained by the computer by dividing W by K, where K may represent any constant, for example, the rated or maximum chairs per minute speed of the conveyor as provided by the manufacturer. This information may be temporarily displayed on demand or permanently printed with a real time indication on demand periodically.

The above-mentioned periodical printing of such information could take place automatically each hour, at the end of each day, or upon each stoppage, according to any desired program. The printed records could be compared and tabulated for desired periods of time such as weeks, months, years or the like to determine management trends of areas where efficiency should be improved or where redesign or repair should take place.

TABLE II

| | |
|---|---|
| 8:32 | start |
| | 10 chairs/min. |
| 9:11 | 8 chairs/min. |
| 9:20 | 10 chairs/min. |
| 10:00 | 875 chairs |
| | 10 chairs/min. |
| | 816 loads |
| | 88 running time |
| | 92.1% load efficiency |
| | 1,132 passengers |
| | 64.7% passenger efficiency |
| 10:21 | J stop |
| | 34 loads |
| | 101 running |
| 10:26 | J start |
| | 1 stop J 5 min. |
| 10:43 | E stop |
| | 53 loads |
| | 118 running |

TABLE II-continued

| | |
|---|---|
| 10:44 | E start<br>2 stops 6 min.<br>J 5 min., E 1 min. |
| 10:47 | 9 chairs/min. |

An example of a print that may be obtain by feeding information from the computer to a conventional recorder or printer is shown in Table II. Upon starting at the beginning of the day and thereafter on change, the printed record will indicate the real time and speed of the conveyor in chairs per minute. On demand, more periodically requested information as to specific information could be printed along with the real time, as shown for 10 o'clock. When one of the safety switches opens, for example cable derailment switch J, the computer will automatically print certain information, such as the switch identification, number of loads presently on the conveyor, running time in minutes, the real time of stoppage, the real time of starting, and the number of stops along with the period of stoppage for each switch. Any type of information desired by management could be programed into the computer for automatic print out and at predetermined intervals, or upon demand.

Figure 8:
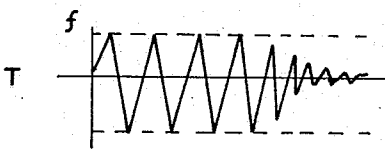
FIG. 8 shows the frequency decay pattern of the generators in FIG. 6.

The computer is extremely rapid in its various functions, and when it detects that a switch has opened, such detection will be so fast that the circuit will still be in a transition period wherein the circuit having a large resistance brought into circuit by an opening of a switch will have a certain time decay to its current change due to the inherent inductance of the various relay coils and the parallel wires running close to each other between towers for the full length of the conveyor which may be 9,000 feet. Although such transition time is measured in a fraction of a second, the computer can perform its functions in thousands of a second or less. Therefore, it is necessary to build into the computer means for determining when the current change has reached a substantially steady state condition before comparisons are made with the memory to determine the open switch identity. With respect to the embodiment of FIG. 6, the computer could repeatedly determine the frequency by counting pulses in a redundant pattern for accuracy; even if a switch was only momentarily opened, counting could go on after the switch was closed due to the substantial decay pattern of the frequency generator as shown in FIG. 8.

Figure 9:
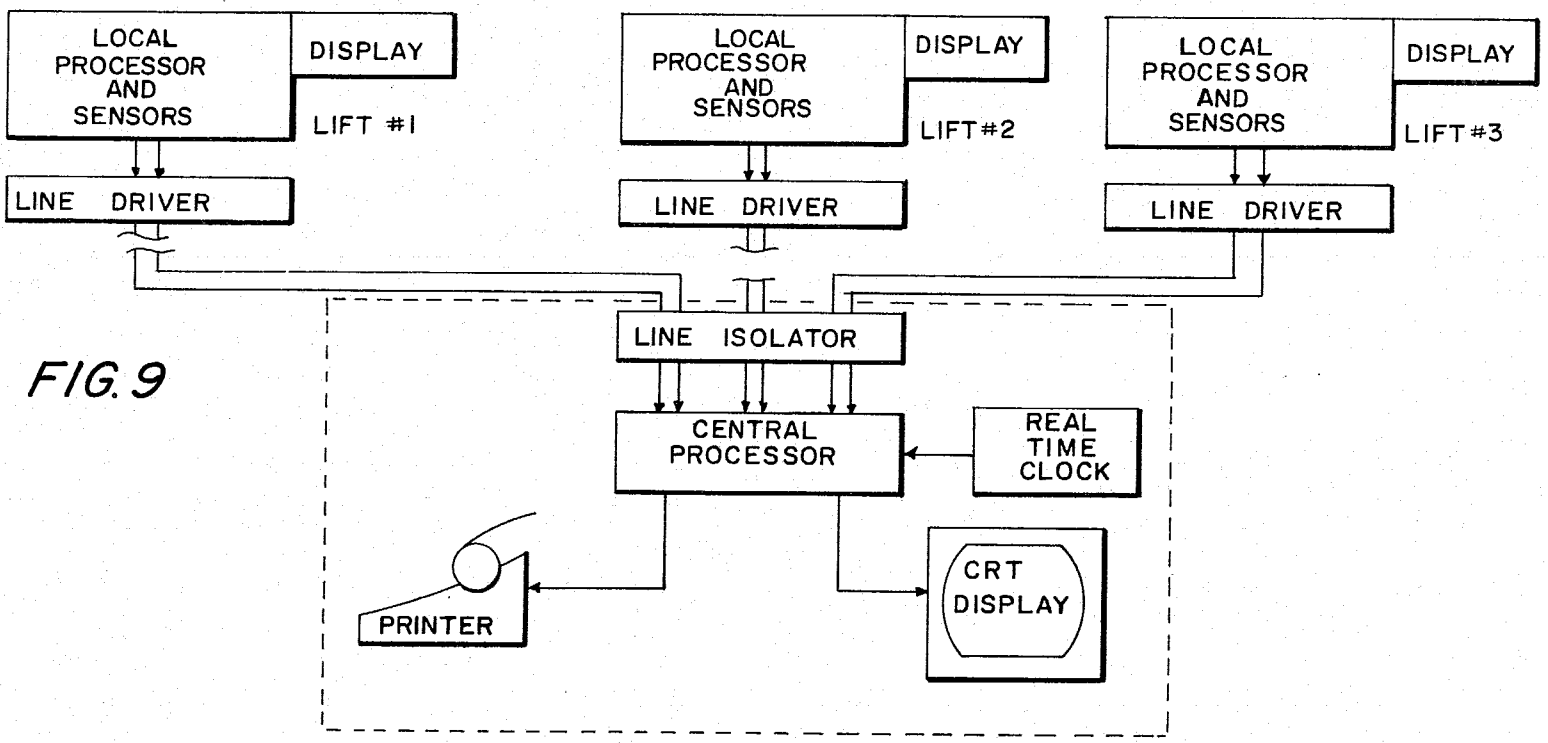
FIG. 9 is a block diagram showing the manner in which information from a plurality of ski lift monitors may be fed to and processed at a central location.

As shown in FIG. 9, a system as previously described with respect to the preceeding figures may be provided for each conveyor or ski lift of an installation involving many such ski lifts, and a line driver may be used to send the information from each such ski lift to a central processor, which could be a central computer. With a large installation involving many ski lifts, it would be desirable to have a display unit considerably more sophisticated than the previously described display unit for the control shack of each ski lift. Such a central display unit could be a cathode ray tube wherein a large quantity of information could be displayed and even shifted so that after a predetermined number of lines of information had been displayed, the whole display would be shifted in one direction so as to add a new line and subtract the oldest line of information. Further, FIG. 9 discloses a printer of any known type that could be used to provide a permanent record of the previously described information. According to known technology, FIG. 9 is provided with a line isolator, which could be any known type of conventional filter, which filter could also be provided for the circuit shown in FIG. 4 to remove random noise. Most timing functions may be inherently performed by the computer, since the computer to be used would employ some means of producing time increments; but in addition, a real time clock is fed into the central processor computer so that the vidio display and the recording printer may print actual time as previously discussed, for example, actually print the time of day at which the information was supplied.

Conventional symbols for electrical components, display elements, a printer, a real time clock, a computer, a memory bank, count and time registers, line drivers, input output interfaces, busses, and the like have been used; since all of these components are standard conventional items, to go into their specific construction would only cloud the essence of the present invention. The details of the component structure form no part of the present invention and any number of different types of such components may be employed in the disclosed combination to produce the desired functions as set forth. By way of example only, the derailment switches may be operated according to the change of a magnetic field, which change will occur with the change of location of the cable adjacent a cable support wheel, or the cable derailment switch may be actuated by a wire stretched adjacent the normal position of the cable and which wire will be broken upon derailment of the cable to actuate the switch, or which cable derailment switch may operate in response to the pressure of the cable engaging the support wheel.

By way of example only, the computer may be: of the Prolog Corp. PLS - 400 system or INTEL's # MCS 4, with memory. A-D and D-A converters are numerous and manufactured by such companies as ITT and RCA.

The method and operation of the present invention has been described along with the description of the drawings and preferred embodiment, so that they will not be separately repeated.

Further modifications, embodiments, and variations are contemplated according to the broader aspects of the present invention in addition to the advantages of the specific disclosures, all according to the spirit and scope of the present invention as defined by the following claims.

What is claimed is:

1. A method of monitoring a ski lift having a drive cable transporting a plurality of passenger carrying units along a conveying run where it has a plurality of spaced cable supports at respective fixed locations, comprising the steps of: automatically sensing derailment of said cable from each of the supports along the ski lift and producing an electric signal at each such location indicating cable derailment, with such derailment electric signals differing from each other electrically in a fixed correlation with their respective locations for identification; controlling the starting and stopping of the ski lift with an electrical closed series circuit; transmitting in the closed series circuit all of said electric signals that have different electric identity characteristics to a central location remote from the signal source fixed locations; automatically identifying any one of said electric signals as to its location according to its different electric characteristic; automatically storing the thus identified signal according to its source identity and providing a visual display of the signal source location at said central location.

2. The method of claim 1, wherein the electrically different signals are produced with different predetermined fixed frequencies, with only one separate frequency being assigned to each of the signal source locations; each of the derailment electric signals having a long frequency decay period to assist in signal location identification for a substantial period of time after a signal generation has terminated.

3. The method of claim 1, further including automatically determining excess slack in the ski lift cable and producing an electric slack signal whenever the slack is greater than a predetermined amount; automatically feeding the slack signal to said central location for storage and simultaneously stopping the ski lift; automatically identifying the electric slack signal and storing it at the central location; automatically determining the presence of a passenger on the ski lift passing beyond a predetermined point downstream from the last unloading zone and stopping the conveyor in response to such presence while simultaneously producing a passenger unload failure electric signal; automatically transmitting the passenger unload failure signal to the central location; automatically identifying and storing the passenger unload failure electric signal at the central location; directly measuring the speed of the ski lift drive cable; automatically stopping the ski lift in response to sensed overspeed and simultaneously producing an overspeed electric signal; automatically feeding the overspeed electric signal to the central location and storing the overspeed electric signal at the central location; providing an oil filled gear box drive for the cable; automatically producing an electric signal corresponding to the oil pressure within the gear box of the ski lift drive dropping a fixed predetermined level and simultaneously stopping the driving of the ski lift; automatically feeding the oil pressure signal to the central location and storing it as to its identity.

4. The method of claim 1, further including the step of providing a main power circuit for driving the ski lift and having therein a power circuit disconnect switch held closed by a main relay coil in the closed series circuit, and greatly reduceing the current carrying capability of the closed series circuit upon sensing derailment to an extent sufficient to deenergize the main relay coil and open the relay switch in the ski lift main power circuit while simultaneously maintaining a small current flow within at least the portion of the closed series circuit carrying the electric signal to the central location.

5. The method of claim 1, including automatically producing a visual display on a cathode ray tube of selected ones of the stored information on demand.

6. The method of claim 1, further including automatically printing all data stored relating to all stoppage on demand with indicia representative of stopping sensor location, real time of ski lift stoppage and elapsed time that the ski lift was stopped.

7. The method of claim 1, including repeating all of said steps at a separate ski lift; automatically transporting all of the data from the individual ski lifts to the common location; and automatically storing all of the data according to the ski lift source.

8. The method of claim 1, further including automatically determining the number of passengers per unit of time carried by the ski lift and transmitting a corresponding electric signal to said central location; and automatically storing the accumulated number of passengers.

9. The method of claim 8, further including automatically determining the number of loaded passenger carrying units per unit of time carried by the ski lift and transmitting a corresponding electric signal to said central location; electronically producing and storing a passenger-load efficiency representing the number of passengers per unit of time divided by the number of loaded passenger carrying units per unit of time.

10. The method of claim 8, further including automatically determining the number of passenger carrying units per unit of time carried by the ski lift and transmitting a corresponding electric signal to said central location; and electronically computing and storing a passenger-capacity efficiency by dividing the number of passengers per unit of time by the number of passenger carrying units per unit of time.

11. The method of claim 1, further including automatically determining the number of passenger carrying units per unit of time carried by the ski lift and transmitting a corresponding electric signal to said central location; and automatically storing the accumulated number of passenger carrying units.

12. The method of claim 11, further including automatically determining the number of loaded passenger carrying units per unit of time carried by the ski lift and transmitting a corresponding electric signal to said central location; and electronically producing a load-capacity efficiency corresponding to the number of loaded passenger carrying units per unit of time divided by the number of passenger carrying units per unit of time.

13. The method of claim 1, further including providing a plurality manual ski lift stop switches at different locations along the ski lift to be used by ski lift employees in stopping the lift, and automatically electrically producing a signal indicating operating of each such manual switch stopping the conveyor, which manual switch signals are electrically different from each other so as to identify their location; transmitting said manual switch signals in the closed circuit to said central location; identifying and storing said manual switch signals.

14. The method of claim 1, further including sensing the number of loaded passenger carrying units leaving the passenger loading zone of the ski lift and producing a correlated load electrical signal; transmitting said load electrical signal to said central location; automatically sensing the number of passenger carrying units leaving the passenger loading zone and producing a correlated electrical capacity signal; transmitting said capacity signal to said central location; storing said capacity signals and said load signals in a shift register having a storage capacity substantially equal to the number of passenger carrying units between the loading zone and the last unloading zone of the ski lift so that the total number of loaded carrying units carried in the shift register will substantially equal the total number of loaded passenger carrying units on the conveyors at ony one time.

15. The method of claim 1, including automatically sensing any passenger carrying unit passing between two adjacent cable supports and producing an electric signal indicating the passage of a carrying unit; automatically transmitting said passenger carrying unit passage signal to the central location; automatically sensing the amount of vertical deflection of the cable between said adjacent cable supports and producing a deflection signal correlated to the amount of such deflection; automatically transmitting said deflection signal to the central location; and storing the deflection signal at the central location only once each time a passenger carrying unit signal is received.

16. The method of claim 1, wherein said step of automatically sensing derailment and producing an electric signal operates a switch at the derailment location in response to derailment for substantially changing the resistance of the closed series circuit at such derailment location, with the change in electrical resistance at each of said locations differing from the change in resistance at any other of said locations so as to be correlated to the specific derailment location for identification.

17. The method of claim 16, wherein said step of automatically sensing cable derailment opens a normally closed switch in parallel with a specific resistor upon derailment so as to pass all of the current flow in the closed series circuit through the specific resistance and thereby lower the current carrying capacity of the closed series circuit; providing a main power electric circuit for driving the ski lift separate from said closed series circuit and having therein a power circuit disconnected switch held closed by a main relay coil in the closed series circuit, and opening the power circuit disconnect switch by reducing the current carrying capacity of the closed series circuit with the opening of any one of the derailment switches.

* * * * *